United States Patent [19]

Larson

[11] 4,309,827

[45] Jan. 12, 1982

[54] ADJUSTABLE SIGHTING DEVICE FOR ARCHERY BOWS

[76] Inventor: Marlow W. Larson, 2735 S. 4050 West, Ogden, Utah 84401

[21] Appl. No.: 84,502

[22] Filed: Oct. 12, 1979

[51] Int. Cl.[3] ..... F41G 1/00

[52] U.S. Cl. ..... 33/265

[58] Field of Search ..... 33/265

[56] References Cited

U.S. PATENT DOCUMENTS

| | | | |
|---|---|---|---|
| 2,542,501 | 2/1951 | Fredrickson | 33/265 |
| 2,574,599 | 11/1951 | Stieber | 124/87 |
| 3,136,063 | 6/1964 | Stebbins | 33/265 |
| 3,475,820 | 11/1969 | Kernan | 33/265 |
| 3,599,337 | 8/1971 | Snodgrass | 33/259 |
| 3,667,444 | 6/1972 | Depatie | 124/87 |
| 3,674,002 | 7/1972 | Diamond | 124/87 |
| 3,766,656 | 10/1973 | Westphal | 124/87 |
| 3,849,894 | 11/1974 | Broughan | 124/87 |
| 4,026,032 | 5/1977 | Smith | 33/265 |
| 4,162,579 | 7/1979 | James | 124/87 |
| 4,170,071 | 10/1979 | Mann et al | 33/265 |

OTHER PUBLICATIONS

Stirling Instrument, catalog of products, 1969 Catalog, p. 265.

*Primary Examiner*—Steven L. Stephan
*Attorney, Agent, or Firm*—M. Ralph Shaffer

[57] ABSTRACT

An improved adjustable sighting device for archery bows wherein the various sighting screw units employed, and as mounted to a suitable mount apart or attachable to a bow, can be made incrementally adjustable not only as to azimuth or windage but also vertically. In particular, and as to vertical adjustment, the device includes releasable locking means whereby sighting screwunits can be releasably fixed in a chosen position and yet sighting released and adjusted for other vertical positions. A serrated slide-lock member may be employed with serrated margins of slots provided in the sighting screw mount. Importantly, and preferably, a rack-pinion arrangement is provided as between mounting plate slots and a sighting screw adjustment member whereby, even though the locking nut of the sighting screw unit is released, the device will still not fall downwardly relative to the slot but rather can be finally adjusted as to vertical orientation prior to nut re-lock.

10 Claims, 8 Drawing Figures

ADJUSTABLE SIGHTING DEVICE FOR ARCHERY BOWS

FIELD OF INVENTION

The present invention relates to sighting mechanisms for archery bows and, more particularly, provides a new and improved adjustable sighting device for archery bows wherein, in addition to azimuth or windage adjustment, the sighting screws can be adjusted continuously or incrementally, in a vertical direction, in a unique way, providing both firm securement and also fine incremental adjustments as to vertical sighting screw orientation, as desired.

BRIEF DESCRIPTION OF PRIOR ART

In the past, prior art as revealed in a series of U.S. patents, has addressed the problem of sighting mechanisms for archery bows. Such patents are the following U.S. Pat. Nos.:

2,574,599
3,450,122
3,667,444
3,674,002
3,766,656
3,849,894
4,162,579

These patents are all relevant to the issues presented in this specification as these patents relate to means for sighting targets at various ranges. Patent '599 relates to adjustable sighting beads on the bow string. Patent '122 teaches vertical adjustment relating to a scale and marker thereof. Patent '444 teaches the employment of a telescopic sight for a bow, with the sight located approximate the eye of the user, with a frame including a locating element adjacent to the archer's head for positioning the sight. Patents '002 and '656 teach up and down adjustment of sighting means by means of reels, drums, and motors associated with a worm and wormwheel arrangement. Patent '898 teaches the use of a rotatable indicator for vertical position sighting purposes.

Patent '579 indicates the use of another type of rotating element, a sighting screw spider which can be rotated for sighting screws of various lengths.

The present invention differs from the above in that both sighting variation and locking functions are simultaneously addressed. Particularly, and in one form of the invention, the rack and rack gear arrangement employed is totally not taught in any of the art and is an improvement thereover in making an easy and yet continuous adjustment for vertical orientation of the sighting screw units employed. Serrated or geared means are also presented in various embodiments for effecting a secure lock so as to preclude inadvertent disturbance of sight mounting as might otherwise be occasioned through shock or vibration of the archery bow employed.

BRIEF DESCRIPTION OF THE INVENTION

According to the present invention, in one form thereof, the sight screw attachment, readily attachable to an archery bow, is provided with a plate having one or more essentially vertical slots. These slots may be angulated if desired but in any event provide for vertical adjustment of sighting screw units mounted to the plate at such slots and overlapping the same as to their locking structures. One edge of the slot is toothed or serrated, whereas the remaining edge can be smooth. The slot is dimensioned so that the sighting screw employed will not become disengaged inadvertently from the serrations or toothed portion of the slot. Accordingly, the slot should be no wider, preferably, than the outside diameter of the gear on the sighting screw less 1-gear tooth height. The locking means, in the form of a knurled adjustment member carrying a pinion or gear, is employed such that the gear or gear portion of such adjustment member is in engagement with the tooth edge of the slot. Locking the sighting screw in place is a washer-nut arrangement as disposed on the screw. The screw is threadable for windage adjustment relative to the adjustment member employed. When it is desired to change vertical adjustment, the nut is backed off slightly and the adjustment member rotated so that the gear progresses along the toothed portion of the slot with which the same is engaged. Accordingly, no inadvertent vertical slippage or dropping of the sighting screw is chanced. Thus, a new vertical position is reached, then the nut is tightened down so that this position of the sighting screw is maintained.

In other forms of the invention, either with or without the rack gear arrangement, a series of serrations, on at least one side of the screw unit mount cooperates with a slide lock member that is also serrated and disposed between the nut and the sighting screw mounting plate. Interengagement as between the slide lock member and the plate and tightening of the nut provided the sighting screw effects a secure lock, whereby vibration by the bow or other shock will not tend to dislodge the sighting screw from its intended mounting position.

OBJECTS

Accordingly, a principal object of the present invention is to provide a new and improved adjustable sighting device for archery bows.

A further object is to provide, in an adjustable sighting device, sighting screw units incorporating a gear portion in a form of a pinion which co-acts with the toothed margin of an adjustment slot provided such sighting screw unit.

A further object is to provide a sighting mechanism for archery bows wherein the sighting screw units employed are continuously and also incrementally adjustable as to both vertical and horizontal positions.

An additional object is to provide in the slide plate of a sighting screw attachment for archery bows a series of teeth or serrations which will cooperate with a similarly serrated or toothed slide lock member, such structure being designed to secure individual sighting screws in their intended positions.

A further object is to provide both a gear lock and also a separate serration lock for individual sighting screw units and their mounting to an archery bow sighting attachment.

BRIEF DESCRIPTION OF DRAWINGS

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

BRIEF DESCRIPTION OF PREFERRED EMBODIMENTS

Figure 1:
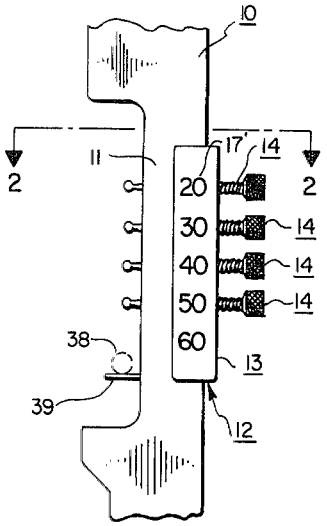
FIG. 1 is a fragmentary front elevation of an archery bow, facing the user, and incorporating a sighting screw attachment as contemplated by the present invention.

In FIG. 1 archery bow 10 has a central portion 11 disposed above the usual hand grip, which is provided with sighting screw attachment 12. Sighting screw attachment 12 incorporates a sighting screw mount 13 and also a plurality of sighting screw units 14 mounted thereto.

Figure 5:
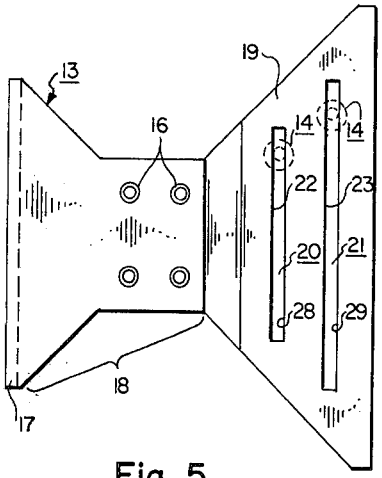
FIG. 5 is a front elevation of the bracket of the sighting screw attachment, is enlarged, and is taken along the line 5—5 in FIG. 2.

Sighting screw mount 13 is mounted to the central portion 11 of bow 10 by means of a series of bolts or screws 15 or other suitable attachments. Such attachment may be accommodated by a series of desired apertures 16 in FIG. 5, by way of example.

Figure 2:
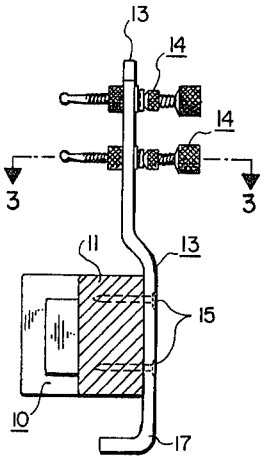
FIG. 2 is a transverse horizontal section taken along the line 2—2 in FIG. 1.
Figure 3:
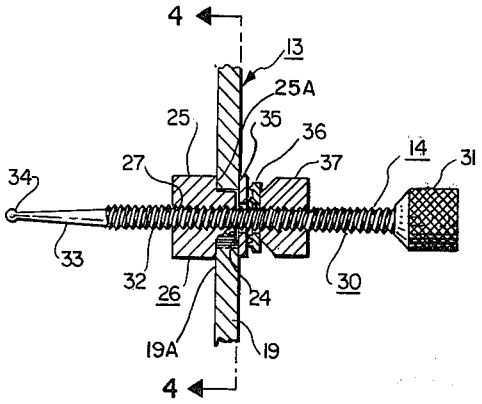
FIG. 3 is an enlarged detail, principally in section, and taken along the line 3—3 in FIG. 2.
Figure 4:
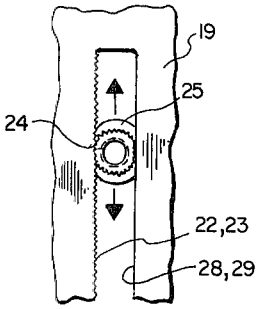
FIG. 4 is an elevation, shown in fragmentary view, and taken along the section line 4—4 in FIG. 3, illustrating a representative cooperation of the pinion or gear portion of the sighting screw unit with a toothed edge of a slot provided the plate which mounts the sighting screw units to the bow.

In considering further FIGS. 1–5 it is seen that the sighting screw mount may simply comprise a formed plate, the same having a front flange 17 provided numeraled indicia 17′ representing various range markings and, in addition, mounting portion 18 and slotted plate portion 19 contiguous therewith. Disposed in plate portion 19 are vertical slots 20 and 21, one side 22, 23 of which is respectfully serrated or toothed provide, in essence, respective rack gear surfaces at 22 and 23, respectively. Cooperating with rack gear surfaces 22, 23, see FIG. 4 is a gear 24 which, with boss 25 having reaction surface 25A abutting plate portion side 19A, forms adjustment member 26. Adjustment member 26 is internally threaded at 27; boss 25 thereof is preferably knurled exteriorly and which integrally includes the gear 24 as a portion of a molded or otherwise formed unit. The rack gear will be so dimensioned that its gear teeth mesh with the respective rack gear surfaces 22, 23, the gear teeth diametrically opposite to the meshed gear teeth will touch or nearly touch smooth surfaces 28, 29. Thus, the gears 24 of the respective sighting screws units 14, hereinafter to be described in detail, will mesh with the respective rack gear surfaces and yet will not slip out of mesh, owing to the proximity of the teeth on the other side of the gear to the respective smooth surfaces 28, 29. For ease of installation, the several adjustment members 26 may be made of plastic such as nylon that is slightly depressable and resilient, this so that the gear or gear portions 24 of the respective adjustment members 26 may be easily inserted; however, the gear, boss, combination comprising the several adjustment members 26 may in fact be rigid and the gear still inserted in mesh condition with the two rack gear surfaces 22, 23. Preferably boss 25 will be knurled for easy thumb and finger manipulation. The width of the several gears 24 should be equal to or, preferably, slightly less than the width of slotted plate portion 19 of the sighting screw mount 13.

In considering FIGS. 1–3 it is seen that the sighting screw unit 14, in addition to including adjustment member 26, also comprises a sighting screw 30 comprised of a head 31, a threaded shank 32, a shank extension 33 and bead 34, all integrally formed together. Washer 35 and star washer 36 are backed by interiorly threaded nut 37 that is preferably exteriorly knurled.

In operation as to the structure shown in FIGS. 1–5, to sight in the arrow 38 resting upon rest extension 39 of the bow, this for a particular range and aximuth, bead 34 is adjusted for proper azimuth so as to be in line with the horizontal axis of arrow 38. This is accomplished by the loosening of nut 37 to the right in FIG. 3 and then adjusting sighting screw 30 so that bead 34 is properly aligned; thereafter the nut is tightened down upon washers 35 and 36.

Once this transverse adjustment is made, the sighting screw can be adjusted up and down within respective slots 20 and 21 by simply barely loosening the nut 37 and then, by thumb and finger manipulation, slightly rotationally displacing boss 25 so that gear 24 is turned within its respective slot, this to ride down the serrations or gear teeth comprising a respective rack gear surface 22, 23. It is noted in this action that there is not a chancing of a sudden dropping of the sighting screw 30; rather, incremental vertical adjustments of the sighting screw unit is now made possible, this through the rack-gear cooperation between gear 24 and the rack gear or serrated surfaces 22, 23, see FIG. 4.

Once an incremental or other vertical adjustment is achieved as to sighting screw unit 14, nut 37 is again tightened down against star-washer 36 and washer 35 to resecure the unit 14.

The employment of both of the slots 20 and 21 is desirable since the sighting screw unit 14 can be staggered to effect close range increments for modern-day high speed bows.

If desired, where the adjustment member 26 is made of plastic, there can be a metal insert fixed in the interior of boss 25, for example, to provide the screw-threaded interior surface for threaded shank 32.

If desired, in effect, azimuth adjustment of sighting screw 30 can be accomplished even without backing off the nut 37.

The use of a pinion gear, rack gear combination in the form of unit 24 and rack gear surfaces 22, 23 has been found to be highly desirable in making possible fine incremental adjustments up and down of the individual sighting screw units prior to tightening of the respective nuts 37 for the chosen horizontal positions achieved.

Figure 6:
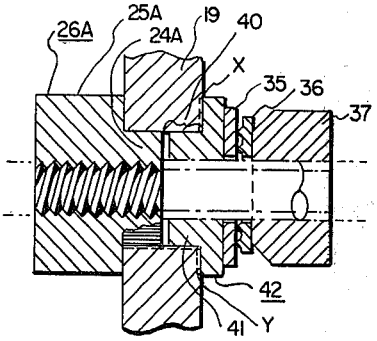
FIG. 6 is a sectioned detail, similar to the central portion of FIG. 3, but illustrates an alternate embodiment of the invention wherein gear portion is foreshortened as to width and the structure includes a serrated slide lock member or washer.

FIG. 6 represents a modification of a representative sighting screw unit wherein, this time, adjustment member 26A, corresponding to adjustment member 26 in FIG. 3, is provided with a thinner gear or gear portion 24A integral with boss 25A. The purpose for this is to include a space 40 within which the central boss 41 of slide lock member 42 can be positioned. Slide lock member 42 includes a plate 43 integral with central boss 41, the plate 43 having vertical serrated or gear toothed margins 44 and 45. These margins with mesh with similarly serrated or gear toothed margins 46 and 47 which may be disposed on opposite sides of slots 20 and 21 in slotted plate portion 19A corresponding to slotted plate portion 19 in FIG. 5. Slide lock member 42 has a central aperture 48 that is unthreaded and which allows for the passage of threaded shank 32 of sighting screw 30.

Accordingly, to effect locking, in assembly the slide lock member 42 is urged in the direction of arrow 50 so that margins 44 and 45 may engage, upon the tightening of nut 37, the serrated or toothed portions 46 and 47 associated at the margins of each of the slots 20 and 21. Accordingly, not only is a lock provided in one direction relative to the gear or gear portion 24A and its cooperation with the teeth at 22 and 23 of the respective slots, but also there is a 90°-related locking condition at X and Y, see FIG. 6, at which points or regions tooth margins 44 and 45 interlock with margins 46 and 47, see FIG. 7. It further serves to prevent a tendency of the sighting screw units to jar loose, which might otherwise be the case were locking tension not provided as for modern day powerful hunting or target bows.

Figure 7:
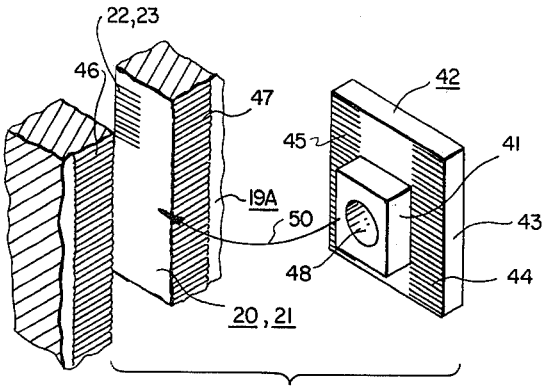
FIG. 7 is an exploded view of the slide washer in FIG. 6 and the fragmentary serrated surfaces proximate the mounting plate slots of the sighting screw attachment mounting plate.
Figure 8:
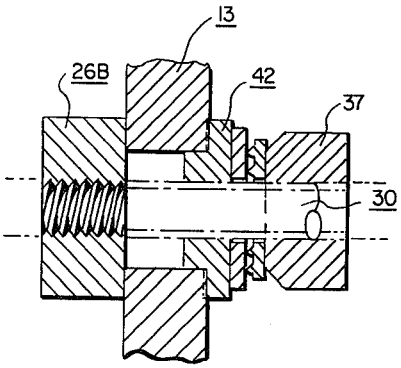
FIG. 8 is a fragmentary section similar to FIG. 6, but illustrates that in another embodiment of the invention the gearing mechanism can be removed and, in lieu thereof, the slide washer employed to lock positively the sighting screw units in their desired locations.

FIG. 8 illustrates another embodiment of the invention wherein, for the adjustment member 26B, corresponding to adjustment members 26 and 26A in FIGS. 3 and 6, there is simply eliminated the gear or gear portion as at 24 in FIG. 3; rather, the locking desired finds reliance simply upon the use of slide lock member 42 in FIG. 3 and detailed in FIG. 7. Accordingly, where the nut 37 is tightened there is a lock as between the slide lock member 42, relative to its serrated margins 44 and 45, and the serrated slot margins 46 and 47, by way of example.

Preferably, however, the gear feature as is provided at gear or gear portions 24 and 24A in FIGS. 3 and 6, respectively, is highly desirable and are an unusual improvement over any locking structure, even including slide lock member 42, when taken alone. This again is effected through the employment of the rack, pinion gear arrangement as between gear 24 and surfaces 22 and 23, enabling not only a secure lock against vertical jarring, when the slots are spaced so that the gear teeth touch or nearly touch the smooth surfaces 28 and 29 without chancing an inadvertent disengagement of the gear with the serrated surfaces 22 and 23, but also, importantly, where one can simply adjust incrementally and in fine increments, the sighting screw up and down by simply manually rotationally displacing boss 25 in FIG. 3.

The gear teeth spacing as to the serrated surfaces 22 and 23 and the gear teeth associated with gear 24 can be very small, i.e., of the order of a few thousanths of an inch, this if desired.

Sighting screw 30 may be considered as a sighting element, whether threaded or unthreaded, and a part of the sighting screw-or sighting element unit 14. Likewise, sighting screw mount 13 may be considered as a bracket to which units 14 are mounted.

What the present invention provides, therefore, is a way and means by which one or several sighting screw units as at 14 can be mounted and be made adjustable in very fine adjustments, and this without chancing inadvertent vertical descends of the sighting screw units or dislodgment thereof from their respective mount as might otherwise be occasioned with modern day high-power archery bows.

While particular embodiments of the present invention have been shown and described, it will be obvious to those skilled in the art that changes and modifications may be made without departing from this invention in its broader aspects, and, therefore, the aim in the appended claims is to cover all such changes and modifications as fall within the true spirit and scope of this invention.

I claim:

1. A sighting attachment for archery bows, including, in combination: a mount provided with means facilitating attachment to an archery bow, said mount including a plate portion provided with an interior slot; an elongate transversely disposed sighting element unit releasably secured to said plate portion and including a sighting element passing through said slot and having a sighting tip, said sighting element unit and said plate portion, proximate said slot, each having mutually cooperable, releasably-engaged toothed means for releasably fixing the position of said sighting element unit relative to said plate portion at said slot, said sighting element including position locking means, said toothed means of said sighting element unit comprising revolvable round gear means having an enlarged reaction surface abutting a side of said plate portion.

2. The combination of claim 1 wherein said sighting element is provided with a pinion gear as a portion of said round gear means, said plate portion having as said toothed means a toothed rack surface engaging said pinion gear and in part defining said slot, said pinion gear being dimensioned relative to said slot whereby said pinion gear remains in engagement with said rack surface when said sighting element unit is tightened and loosened relative to said plate portion.

3. The combination of claim 1 wherein said plate portion has as said toothed means serrated slot margins contiguous with said slot, said sighting element unit being provided with a slide lock member having a boss slideably disposed in said slot and opposite serrated margins disposed on opposite sides of said boss and in mutual engagement with said serrated slot margins, said sighting element unit being provided with an adjustment member disposed on one side of and backing said plate portion and, as said position locking means, a locking element disposed on the remaining side of said plate portion and backing said slide lock member.

4. The combination of claim 1 wherein said slot has a toothed edge as said toothed means, said sighting element unit including a sighting screw; an adjustment member disposed on one side of said plate portion, provided with a pinion as said toothed means disposed in said slot and engaging said toothed edge, and threadedly disposed on said sighting screw; and nut means threaded onto said sighting screw on the remaining side of said plate portion.

5. A sighting attachment for archery bows, including, in combination: a mount provided with means facilitating attachment to an archery bow, said mount including a plate portion provided with a slot; a sighting element unit releasably secured to said plate portion and including a sighting element passing through said slot, said sighting element unit and said plate portion, proximate said slot, each having mutually cooperable, releasably-engaged toothed means for releasably fixing the position of said sighting element unit relative to said plate portion at said slot, said sighting element including position locking means, said plate portion having as said toothed means serrated slot margins contiguous with said slot, said sighting element unit being provided with a slide lock member having a boss slideably disposed in said slot and opposite serrated margins disposed on opposite sides of said boss and in mutual engagement with said serrated slot margins, said sighting element unit being provided with an adjustment member disposed on one side of and backing said plate portion and, as said position locking means, a locking element disposed on the remaining side of said plate portion and backing said slide lock member, and wherein said sighting element unit includes a sighting screw carrying a pinion as an additional portion of said toothed means of said sighting element unit, said plate portion having a toothed edge, as an additional portion of said toothed means of said plate portion, in part defining said slot and engaging said pinion.

6. For attachment to a bracket provided an interior slot having a rack edge, said bracket being carried by an archery bow, a sighting element unit including, in combination: an elongate horizontal sighting element having a threaded shank, a manually adjustable adjustment member threaded onto said shank and carrying pinion means for engaging and being retained in engagement with said rack edge, and nut means threaded onto said shank and facing said pinion means , said pinion means having an enlarged radially extending reaction surface for face abutting said bracket, and wherein, interposed between said adjustment member and said nut means, said sighting element unit also includes a slide lock member having a projecting boss and also a plate integral with said boss and having opposite toothed margins facing said adjustment member.

7. In combination, an archery bow bracket having plural interior slots provided with respective toothed regions, plural sighting element units passing transversely through said slots, releasably locked to said bracket proximate said slots, and having respective annular toothed means within said slots engaging said toothed regions, said annular toothed means each having a diameter nominally equivalent to the width of that respective one of said slots within which it is disposed, whereby the widths of said slots are sufficiently constrained, relative to said toothed means, to maintain inter-engagement of said toothed means with said toothed portions, respectively, for various positions of said toothed means relative to said slot, said annular toothed means also having a radially projecting enlarged reaction surface face-abutting said bracket.

8. A combination of claim 7 wherein said toothed regions comprise respective toothed slot edges disposed on one side only of each of said slots, said toothed means comprising respective pinions engaging said slot edges.

9. A sighting attachment for archery bows, including, in combination: a forward-to-rearward oriented mount provided with means facilitating attachment to an archery bow, said mount being provided with a slot a side of which is toothed; round gear means disposed in said slot and constrained in toothed engagement with said side, said gear means having a transverse, axial, threaded aperture and also an enlarged radially extending reaction surface face-abutting said mount; a laterally extending, transversely disposed, longitudinally extendable and withdrawable, threaded, windage-adjustable sighting screw adjustably threaded axially through said gear means at said threaded aperture; and means for releasably fixing the position of said gear means within said slot.

10. The attachment of claim 9 wherein said fixing means also comprises means for simultaneously locking the longitudinal position of said sighting screw relative to said gear means.

* * * * *